US007467494B2

(12) United States Patent
Buchta

(10) Patent No.: US 7,467,494 B2
(45) Date of Patent: Dec. 23, 2008

(54) VEHICLE WINDOW ADJUSTMENT DEVICE

(75) Inventor: Christoph Buchta, Neuried (DE)

(73) Assignee: Intier Automotive Closures Inc., Newmarket, Ontario (CA)

( * ) Notice: Subject to any disclaimer, the term of this patent is extended or adjusted under 35 U.S.C. 154(b) by 256 days.

(21) Appl. No.: 10/568,631

(22) PCT Filed: Sep. 15, 2004

(86) PCT No.: PCT/CA2004/001624

§ 371 (c)(1),
(2), (4) Date: Feb. 16, 2006

(87) PCT Pub. No.: WO2005/026487

PCT Pub. Date: Mar. 24, 2005

(65) Prior Publication Data

US 2006/0283088 A1 Dec. 21, 2006

(51) Int. Cl.
*E05F 11/48* (2006.01)

(52) U.S. Cl. ..... 49/352; 49/212; 49/502

(58) Field of Classification Search ..... 49/352, 49/348, 349, 502, 212
See application file for complete search history.

(56) References Cited

U.S. PATENT DOCUMENTS 1,503,500 A * 8/1924 Heintz ..... 474/136
4,761,915 A 8/1988 Marz
4,956,942 A * 9/1990 Lisak et al. ..... 49/502
4,965,942 A * 10/1990 Hoszowski ..... 33/730
5,430,976 A 7/1995 Wirsing
5,855,095 A 1/1999 Dedrich et al.
6,425,208 B1 * 7/2002 Klueger et al. ..... 49/502
2003/0131534 A1 * 7/2003 Cardine et al. ..... 49/212

FOREIGN PATENT DOCUMENTS

DE 10044845 A1 4/2002
EP 1295742 A1 3/2003

* cited by examiner

*Primary Examiner*—Jerry Redman
(74) *Attorney, Agent, or Firm*—Clark Hill PLC

(57) ABSTRACT

A device for adjusting a window regulator in a vehicle door, having a profiled base element (110) positionable on a lower section of the vehicle door and provided with a first elongate hole (111*b*) in its lower side and a second elongate hole (111*a*) in its upper side. A slider (112) slidingly moves within the base element (110) and includes a hole (113) aligned with the first elongate hole (111*b*). A screw extends through the hole (113) in the slider and the first elongate hole (111*b*) aligned therewith. A bolt (116) is fixedly attachable to the window regulator extending through the second elongate hole (111*a*) and includes a threaded rod engaging the threading of screw (114). The screw (114) can be turned from a first position, in which it does not engage the slider (112), to a second position, in which it engages the slider (112) with the first screw end (114*b*). The device provides for simple compensation of tolerances in connection with the vehicle door and for the window regulator.

5 Claims, 3 Drawing Sheets

VEHICLE WINDOW ADJUSTMENT DEVICE

FIELD OF THE INVENTION

This invention relates to a device for adjusting a vehicle window regulator.

BACKGROUND OF THE INVENTION

It is necessary for side windows on automotive vehicles to be movable between an open position, in which the window is concealed within the vehicle door, and a raised position closing the open area above the door panel.

In hard top vehicles, the upper portion of the door usually includes a peripheral frame structure having a weatherstrip adapted to form a seal with the edge of the window when the window is in the closed position.

Convertible or soft top vehicles possess no such upper peripheral frame structure, so that the window must seal against a weatherstrip carried by the fabric structure forming the roof of the vehicle.

Due to folding requirements for the fabric top, this offers limited support when it is in the raised position. Consequently, the weatherstrip on the fabric top structure may at times fail to seal adequately along the upper edge of the side window.

In order to prevent potential water leakage paths between the vehicle side windows and the associated weatherstrip, it is necessary to adjust the stroke of the window so that the upper edge of the window seals against the associated weatherstrip. Herein, it is necessary to avoid excessive distortion or stretching of the fabric top, or the development of an excessive sealing force that might interfere with the opening or closing of the fabric top.

Adjustment of the window movement stroke after the vehicle is fully assembled is not easily achievable, as the window guide structure is completely sealed by the door outer panel and the door inner trim panel.

A vehicle window track adjustment system is disclosed in U.S. Pat. No. 6,425,208 B1. Herein, a vertically disposed guide structure for the window is provided with an adjustment mechanism, whereby the guide structure can be raised or lowered to change the location of the stop and the orientation of the window upper edge to the associated weatherstrip.

From U.S. Pat. No. 4,956,942 there is known a window adjustment apparatus for use with an automotive vehicle type of window assembly of the type having an elongate guide channel defining a longitudinal axis and which mounts a window for reciprocal motion relative to a vehicle body panel such as a vehicle door, and a pivot arrangement which mounts the guide channel for pivotal movement generally about one end thereof and within the vehicle body panel in which the guide channel is located.

DE 100 44 845 A1 discloses a vehicle door with adjustment means for a window regulator. This window regulator comprises tolerance adjusting means in the region of the lower attachment point of the guide rails within the door structure.

The present invention attempts to provide a simple and reliable means for adjusting the orientation of a window regulator and thus the stroke of a vehicle window.

SUMMARY OF THE PRESENT INVENTION

The present invention relates to a device for adjusting a window regulator in a vehicle door, including a device for adjusting a window regulator in a vehicle door, having a profiled base element positionable on a lower section of the vehicle door and provided with a first elongate hole in its lower side and a second elongate hole in its upper side. A slider slidingly moves within the base element and includes a hole aligned with the first elongate hole. A screw extends through the hole in the slider and the first elongate hole aligned therewith. A bolt is fixedly attachable to the window regulator extending through the second elongate hole and includes a threaded rod engaging the threading of screw. The screw can be turned from a first position, in which it does not engage the slider, to a second position, in which it engages the slider with the first screw end. The device provides for simple compensation of tolerances in connection with the vehicle door and for the window regulator.

The device according to the invention provides a simple, reliable and highly effective means for adjusting a window regulator, especially guide rails for window regulators in doors of convertible type vehicles.

The device of the present invention furthermore provides for a simple compensation of tolerances in connection with the vehicle door and/or the window regulator.

According to a preferred embodiment of the invention, the inner sides of the base element and the outer sides of the slider are provided with interacting notches. By means of such notches, predefined positions of the slider relative to the base element can easily be set, such positions defining a Y-position of the lower side of the window adjustment device. Thus an adjustment of the angular position of the vehicle window in order to assure a proper sealing engagement of the upper edge of the window in relation to an associated weatherstrip can be provided.

Preferably, the second screw end of the screw is provided with a slot. Hereby, an engagement tool for turning the screw, such as a screw driver, can easily be applied to the screw end.

A preferred usage of the device according to the present invention is in connection with a window regulator in a convertible type vehicle.

DESCRIPTION OF A PREFERRED EMBODIMENT OF THE INVENTION

Figure 1:
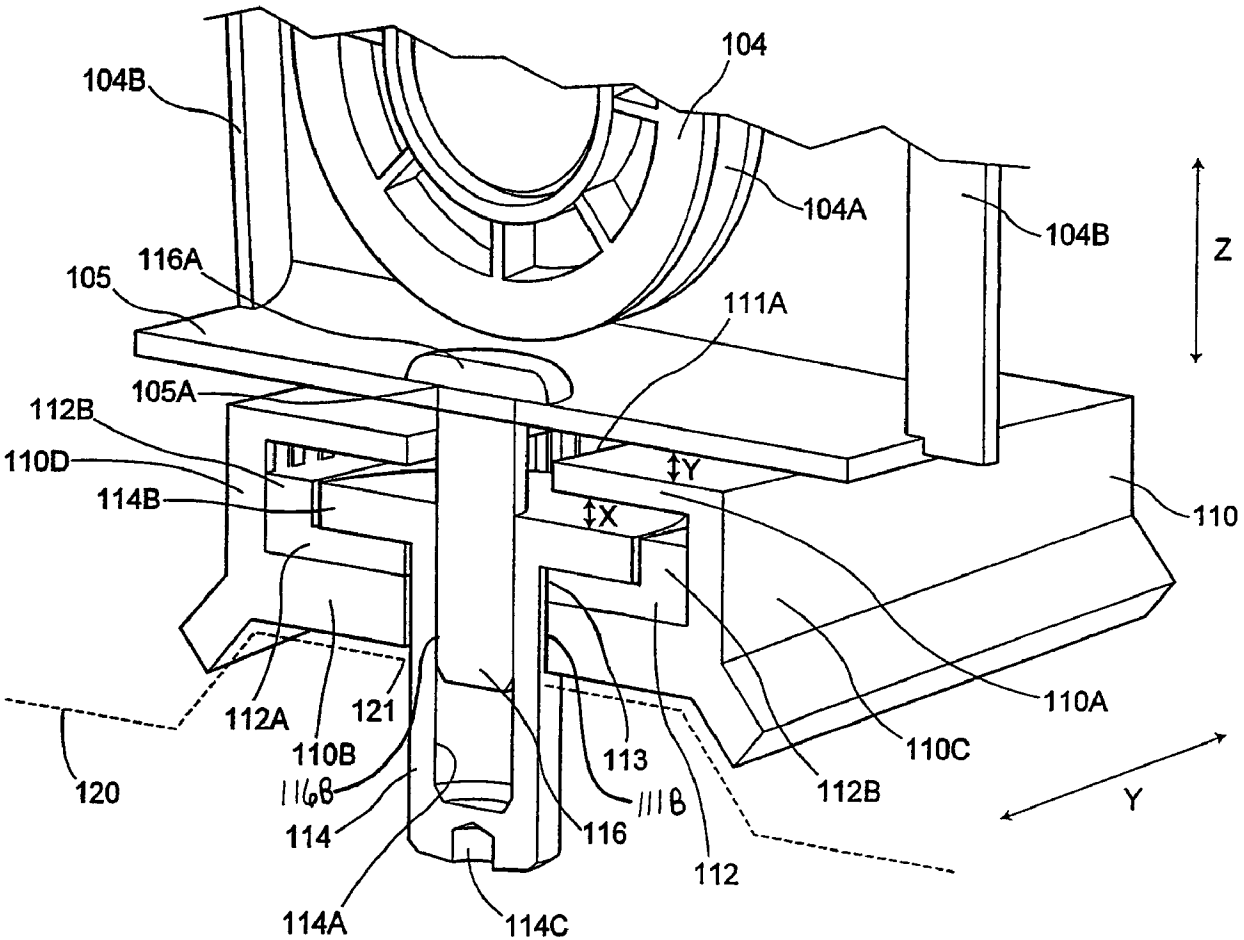
FIG. 1 is a fragmentary perspective view of a preferred embodiment of the device according to the invention in its final state.
Figure 2:
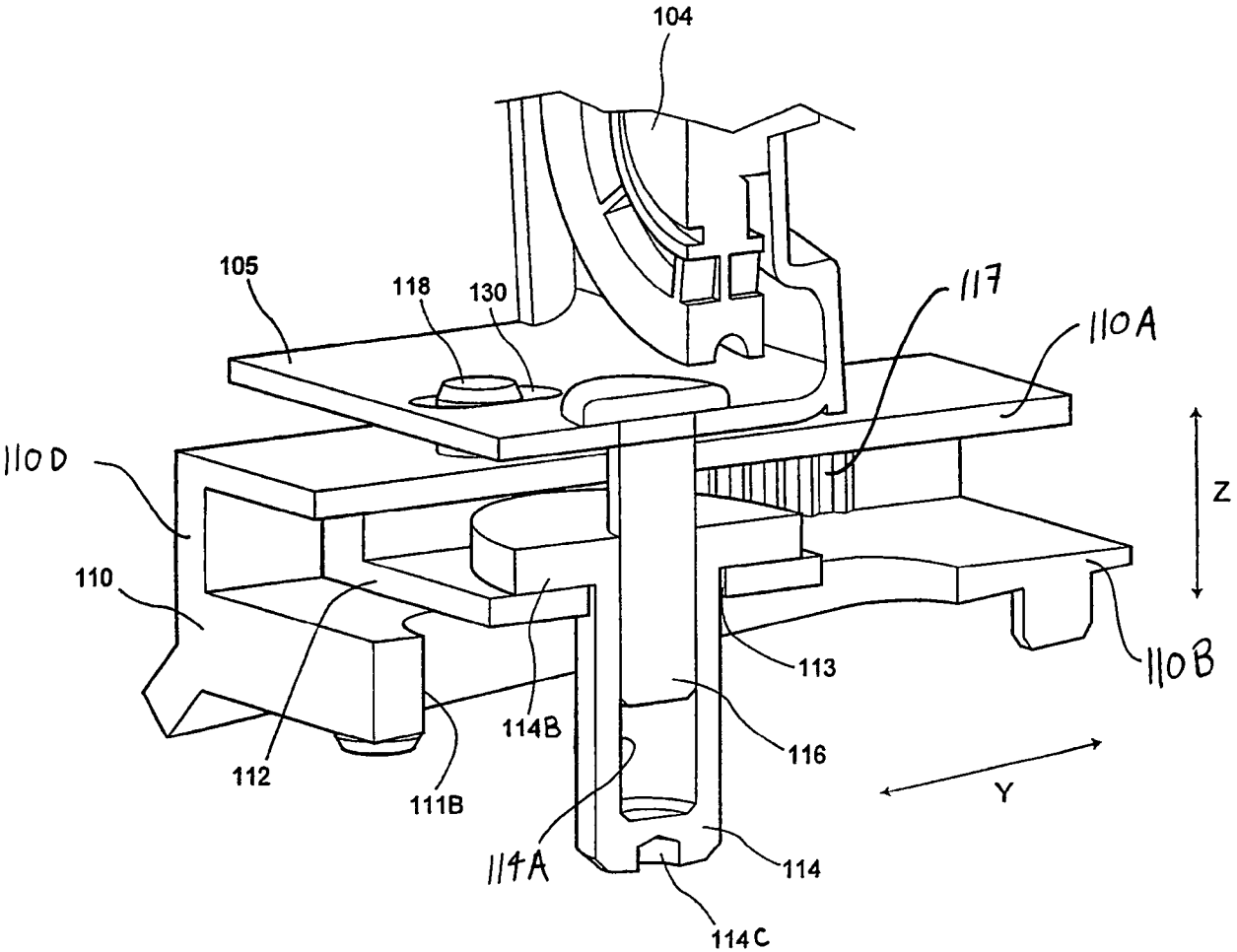
FIG. 2 is a further fragmentary perspective view of the device according to FIG. 1 in its final state, and FIG. 3 in a fragmentary perspective view of the device according to FIGS. 1 and 2 in its initial or delivery state.

Referring to FIG. 1, a window regulator 104 fitted with the adjustment device according to the present invention is shown in a perspective view. It should be noted that FIGS. 1 and 2 show the final state of the device with respect to the window regulator 104, in which a relative movement of window regulator 104 and adjustment device is blocked due to pressure-force interaction between these elements, as will be further described below.

The window regulator 104 comprises deflection rollers and guide rails. In the Figure, only one deflection roller 104*a* and one guide rail comprising dual rails 104*b* connected to one another by means of a platform 105 are shown. Further components of the window regulator 104 are not shown in FIGS. 1 to 3, as they are not relevant for this aspect of the invention.

The upper section (not shown) of the window regulator 104 as well as the upper sections of the dual rails 104*b* are fixedly attached to an upper section of a vehicle door, typically just below an upper edge of the vehicle door, for example, to a belt line reinforcement member. Without the fixation of the window regulator 104 to the lower section of the vehicle door by means of the adjusting device according to the present invention and as described below, a pivotal movement of the window regulator 104 about its fixation at the upper section of the vehicle door is achievable.

The lower ends of the dual rails 104*b* are integrally connected to platform 105, which is provided with a hole 105*a* therein. The dual rails 104*b* extend in an essentially vertical direction, usually referred to as the Z-direction.

The positioning device comprises a profiled base element 110, preferably made of a plastics material. The base element 110 is positioned on a section in a lower region of the vehicle door depicted by a dashed line 120 in FIG. 1. The lower region 120 of the vehicle door is provided with a hole 121, the function of which will be described below.

The base element 110 comprises an upper side 110*a*, a lower side 110*b* and walls 110*c*, 110*d* connecting the upper side 110*a* and the lower side 110*b*. Lower side 110*b* is formed with two wing-like extensions extending downwardly at an angle from the lower side 110*b*.

In the upper 110*a* and lower 110*b* sides of the base element 110 there are provided elongate holes 111*a*, 111*b* respectively.

The elongate holes 111*a*, 111*b* extend essentially horizontally and perpendicularly to the direction of motion of the (not shown) vehicle. This direction is usually referred to as the Y-direction.

A slider 112 is positioned within the base element 110, resting on the inside of lower side 110*b*. The slider 112 comprises a base portion 112*a*, extending horizontally, and two walls 112*b*, extending essentially in Z-direction. The slider 112 is also preferably made of a plastics material. The slider 112 is formed with a hole 113 in its base portion, which is aligned with the elongate holes 111*a*, 111*b*.

A screw 114 provided with an inner threading 114*a* extends through the hole 113 in the slider 112 and the elongate hole 111*b* in the lower side 110*b* of base element 110. The screw 114 is provided with a first screw end 114*b*, formed as a screw head, and a second screw end 114*c*, formed with a slot, in which means for turning the screw 114 can be engaged. The first end 114*b* of the screw 114 rests on the base portion 112*a* of the slider 112. The screw 114 furthermore extends downwardly through hole 121 provided in door section 120, this hole 121 being aligned with holes 113 and 111*b*.

A bolt 116 extends downwardly through the hole 105*a* in platform 105 and is fixedly attached to the platform 105. Bolt 116 is formed with a bolt head 116*a* resting on the platform 105. The lower end of the bolt 116 is formed as a threaded rod 116*b* which engages the inner threading 114*a* of screw 114.

By means of turning the screw 114 (for example by inserting an appropriate turning means in the slot formed in the second screw end 114*c*), an adjustment of screw 114 in Z-direction can be achieved.

As mentioned, the window regulator 104, and thus platform 105 and bolt 116 are essentially fixedly mounted to the vehicle door in Z-direction in the upper section of the vehicle door.

Figure 3:
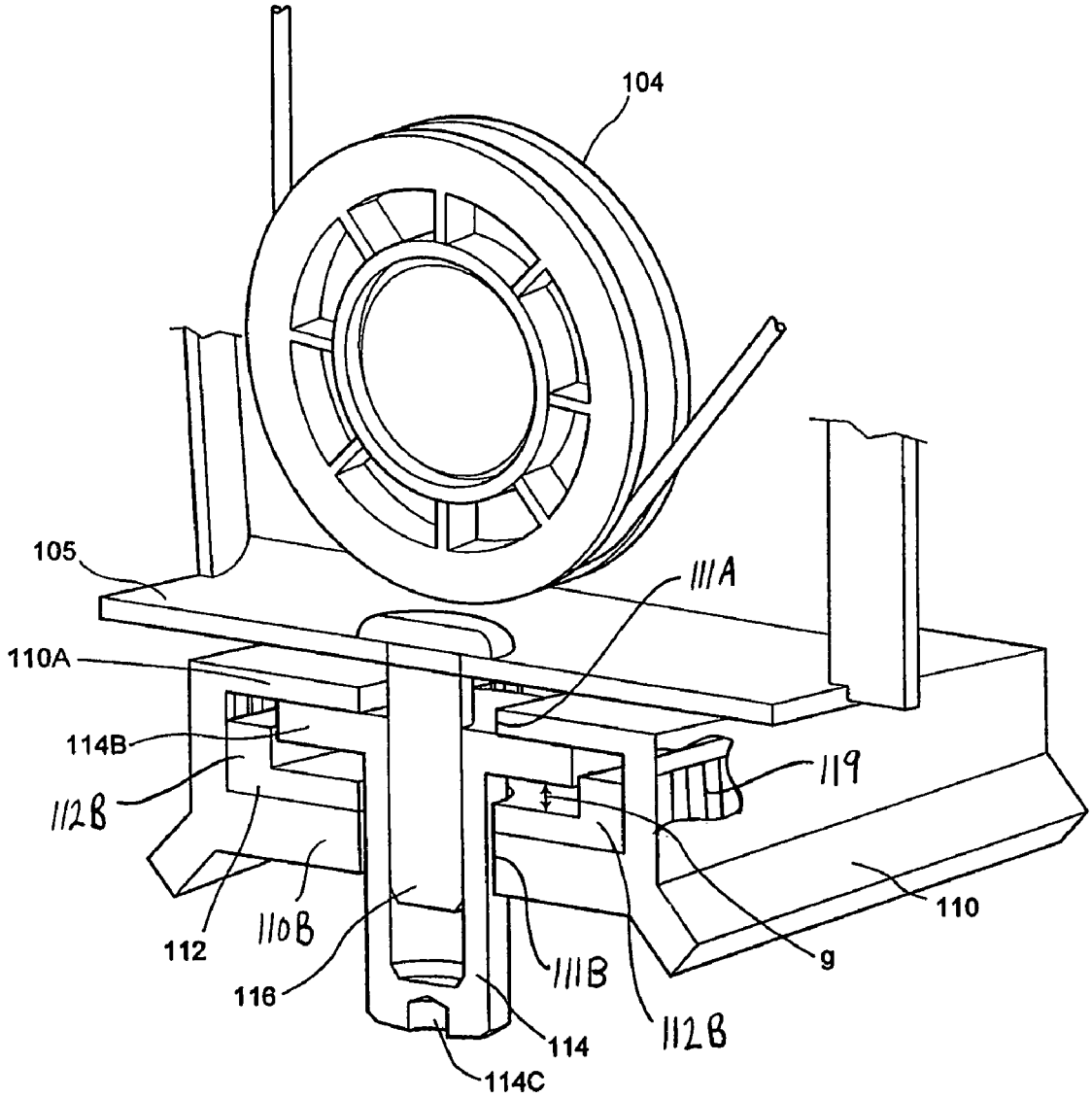

Referring to FIG. 3, the adjustment device according to the invention is shown in its delivery state. As can be seen, the head 114*b* of screw 114 abuts the inside of upper side 110*a* of base element 110.

Furthermore, the outside of upper side 110*a* abuts platform 105. Thus, there are, initially, no gaps between screw head 114*b* and upper side 110*a* as well as upper side 110*a* and platform 105. Rather, in the initial state, a gap g is provided between slider 112 and head 114*b*.

The screw 114 is thus initially, i.e. in its delivery state, in a position, where it engages the inside of the upper part 110*a* of the base element 110. With the screw 114 in its delivery state, a gap x as indicated in FIG. 1 is minimized. The same holds for a gap y depicted in FIG. 1 between the upper side 110*a* of the base element 110 and platform 105. In this position, i.e. with the first screw end 114*b* not engaging the slider 112, the slider 112 is slideable within the base element 110 in Y-direction. Thus, the pivotal movement of the window regulator 104 as mentioned above, about its fixation in the upper section of the vehicle door, can be achieved. By means of such a sliding movement of slider 112 a desired angle of the guide rails 104*b* can be effectively set. In order to define specific positions of the slider 112 in Y-direction, the insides of walls 110*c*, 110*d* and the outsides of walls 112*b* are provided with interacting notches 117 and 119, respectively, as shown in FIGS. 2 and 3.

On the upper side 110*a* of base element 110 there is provided at least one pin-like element 118 engaging an elongate hole 130 formed in platform 105. The elongation of hole 130 extends essentially in Y-direction. Thus, a rotation of the guide rail 104*b* relative to the base element 110 in case of a turning of screw 114 can be prevented.

By turning screw 114 relative to bolt 116, screw 114 begins a downward motion relative to the bolt 16 and platform 105, whereby the gaps x and y are created. When the gaps x and y are fully formed, the head 114*b* of the screw 114 begins engaging slider 112. By further turning screw 114, a fixation of slider 112 within the base element 110 can be achieved. In this engaging relationship, a further sliding movement of slider 112, and thus, a further pivotal movement of guide rails 114*b* is effectively prevented.

At the same time, a tolerance compensation in Z-direction is achieved. The device according to the present invention achieves said tolerance compensation by creating a pressure force (essentially in Z-direction) between section 120 of the vehicle door and platform 105 of the window regulator 104. Thus, any deviations or tolerances in Z-direction, for example of the dual rails 104*b* or of the base element 110, can be effectively compensated.

According to a further preferred embodiment, not shown in the Figures, the outside of screw 114 extending downwardly from hole 121 can be provided with a thread. This enables a nut (not shown) with a corresponding inner thread to be engaged on said outside of screw 114, whereby the fixation of screw 114 to section 120 of the vehicle door can be further enhanced.

The invention claimed is:

1. A device for adjusting a window regulator in a vehicle door, comprising:

a profiled base element (110) positionable on a lower section of the vehicle door and provided with a first elongate hole (111*b*) in its lower side and a second elongate hole (111*a*) in its upper side;

a slider (112) slidingly moveable within the base element (110) and provided with a first hole (113) aligned with the first elongate hole (111*b*);

a screw (114) provided with an inner threading and comprising a first screw end (114*b*) formed as a screw head and a second screw end (114*c*), the screw extending through the first hole (113) in the slider and the first elongate hole (111*b*) aligned therewith; and a bolt (116) fixedly attachable to the window regulator extending through the second elongate hole (111*a*) and provided with a threaded rod engaging the threading of screw (114), wherein the screw (114) can be turned from a first position, in which the first screw end (114*b*) does not engage the slider (112), to a second position, in which the first screw end (114*b*) engages the slider (112).

2. The device according to claim 1, wherein the inner sides of the base element (110) and the outer sides of the slider (112) are provided with interacting notches (117, 119).

3. The device according to claim 2, wherein the second screw end (114*c*) of the screw (114) is provided with a slot.

4. The device according to claim 3, wherein the screw (114) extends through a second hole (121) provided in a section (120) of the vehicle, said second hole (121) being aligned with the first elongate hole (111*b*) and the first hole (113) in the slider (112).

5. A device for adjusting a window regulator in a vehicle door, comprising:

a profiled base element positionable on a lower section of the vehicle door and provided with a first elongate hole extending through a lower side of the base element and a second elongate hole extending through an upper side of the base element;

a slider slidingly moveable within the base element and provided with a first hole aligned with the first elongate hole;

a screw provided with an inner threading and comprising a first screw end formed as a screw head and a second screw end having a slot, the screw extending through the first hole in the slider and the first elongate hole in the base element aligned therewith; and a bolt fixedly attachable to the window regulator extending through the second elongate hole and provided with a threaded rod engaging the threading of screw, wherein the screw can be turned from a first position, in which the first screw end does not engage the slider, to a second position, in which the first screw end engages the slider.

* * * * *